US008517433B2

(12) United States Patent
Pritz et al.

(10) Patent No.: US 8,517,433 B2
(45) Date of Patent: Aug. 27, 2013

(54) LOCKING DEVICE OF A DOOR

(75) Inventors: Christian Pritz, Amstetten (AT); Peter Jetzinger, Amstetten (AT); Reinhold Jarolim, Weyer (AT)

(73) Assignee: Knoor-Bremse GmbH, Modling (AT)

( * ) Notice: Subject to any disclaimer, the term of this patent is extended or adjusted under 35 U.S.C. 154(b) by 244 days.

(21) Appl. No.: 12/808,400

(22) PCT Filed: Dec. 19, 2008

(86) PCT No.: PCT/EP2008/010932

§ 371 (c)(1),
(2), (4) Date: Jun. 16, 2010

(87) PCT Pub. No.: WO2009/083190

PCT Pub. Date: Jul. 9, 2009

(65) Prior Publication Data

US 2010/0276945 A1 Nov. 4, 2010

(30) Foreign Application Priority Data

Dec. 21, 2007 (AT) ..... 2112/2007

(51) Int. Cl.
*E05C 5/02* (2006.01)

(52) U.S. Cl.
USPC ..... 292/57; 292/DIG. 62; 292/DIG. 46; 292/201; 292/216

(58) Field of Classification Search
USPC ..... 292/57
See application file for complete search history.

(56) References Cited

U.S. PATENT DOCUMENTS

| | | | | |
|---|---|---|---|---|
| 4,142,751 | A * | 3/1979 | Varda | 292/217 |
| 4,783,102 | A | 11/1988 | Bernard | |
| 4,978,153 | A * | 12/1990 | Hirsch et al. | 292/201 |
| 6,027,148 | A * | 2/2000 | Shoemaker | 292/216 |

FOREIGN PATENT DOCUMENTS

| | | | |
|---|---|---|---|
| AT | 503 155 | A2 | 8/2007 |
| DE | 86 01 065 | U1 | 2/1986 |
| EP | 0 626 494 | A1 | 11/1994 |
| EP | 1 721 802 | A1 | 11/2006 |
| FR | 1 321 314 | A | 3/1963 |

OTHER PUBLICATIONS

International Preliminary Report on Patentability and Written Opinion of the International Search Authority for International Patent Application No. PCT/EP2008/010932.
International Search Report for International Patent Application No. PCT/EP2008/010932 mailed Apr. 2, 2009.

* cited by examiner

*Primary Examiner* — Carlos Lugo
*Assistant Examiner* — Mark Williams
(74) *Attorney, Agent, or Firm* — Barnes & Thornburg LLP

(57) ABSTRACT

The invention relates to a locking device for sliding doors, or for swinging-sliding doors of vehicles, particularly of rail vehicles, by which a locking pin connected to a door leaf is fixed in the closed position thereof. The device is characterized in that in the closed position of the locking pin the same is fixed in this position by a latch, a guide bar connected to the latch and having a notch assumes a position in which a locking element of a locking lever projects into the notch, thus fixing the position of the guide bar and the locking lever in turn is held in the closed position by a toggle lever mechanism that is located in the beyond dead point position.

15 Claims, 4 Drawing Sheets

V
V'
1
2
3
5
8
9
11
13
14
16
21
$F_{act}$
$F_{lever}$
$F_{spring}$

LOCKING DEVICE OF A DOOR

CROSS-REFERENCE TO RELATED APPLICATIONS

The present application claims the benefit of priority to International Patent Application No. PCT/EP2008/010932 filed 19 Dec. 2008, which further claims the benefit of priority to Austria Patent Application No. A 2112/2007 filed 21 Dec. 2007, the contents of which are incorporated herein by reference in their entirety.

The invention relates to the locking device of a sliding door or a hinged sliding door, serving to ensure that, even without the door drive exerting any force, on reaching the locking position the door remains in its locked position even when widely varying forces are acting thereon.

Various such locking devices exist in the state of the art, most of them being designed and fitted to function automatically and independently of the actual door drive, which although necessitating a separate assembly, adjustment and servicing etc., makes them independent of the actual door drive.

Other locking devices act on the door drive and fix it in the position corresponding to its closed position, but these systems suffer from the fact that it is necessary to hold the position in opposition to large forces, which necessitates either large locking forces or long locking travels, neither alternative being seen favorably in view of the small space available and the desire to manage with small forces and thereby small servomotors.

The object of the invention, then, is to specify a locking device of the first type referred to in the introductory part, which does not have said disadvantages but which is compact, can be operated with little force and is easy to arrange and adjust.

According to the invention these objects are achieved in that the locking is accomplished by means of a locking lever, which acts upon a drive bar and in turn is moved between its open position and its locked position by a toggle lever mechanism. The locking lever makes it possible to manage with a small actuator travel for the toggle lever mechanism, since the actual locking travel via the lever can be varied almost arbitrarily, whilst the toggle lever mechanism in turn leads to a complete isolation of the force acting between the actuator and the locking element of the locking lever, so that force has to be applied to the actuator only whilst adjusting the position of the locking lever, the force required for this being extremely small.

Figure 2:
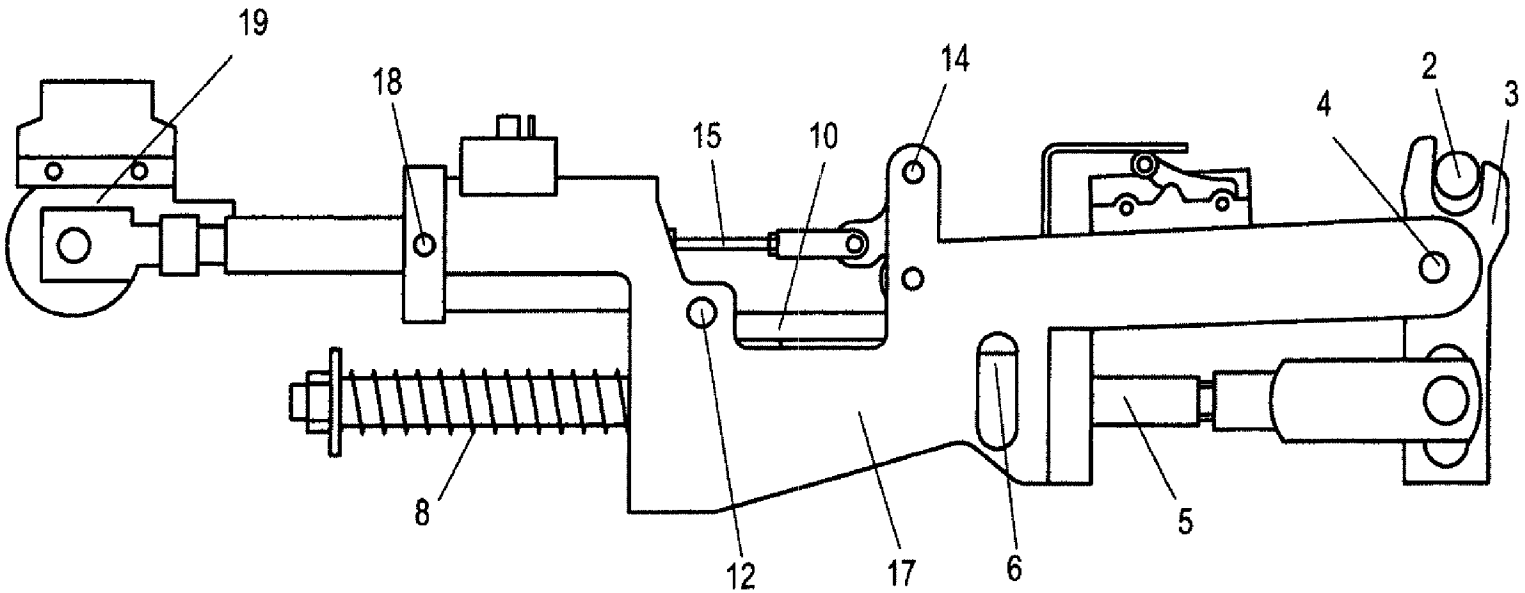
Figure 3:
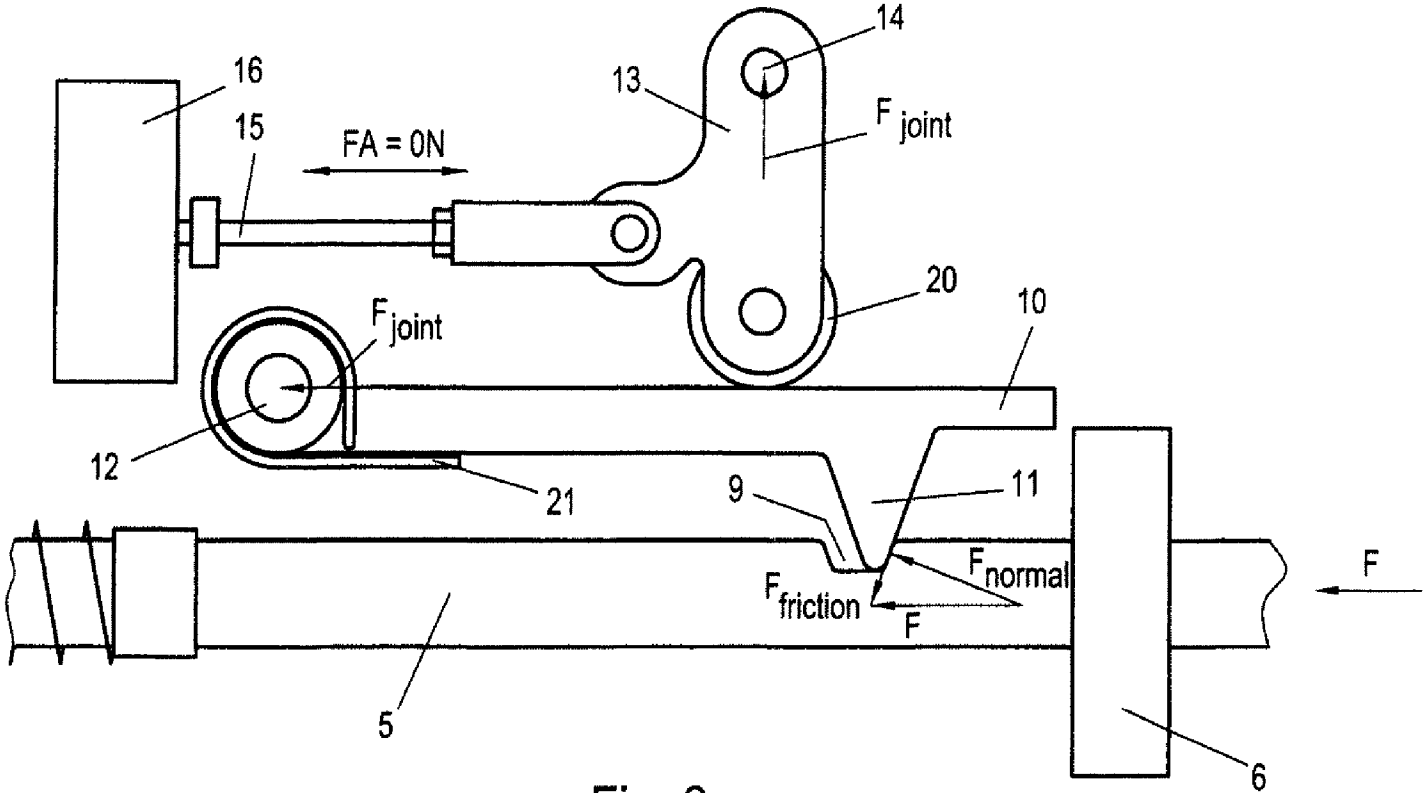

The device will be explained in more detail below with reference to the drawing, without being limited to this. In the drawing FIG. 1 shows the main components of the device according to the invention, FIG. 2 shows the locking unit as a whole, FIG. 3 shows the forces acting on the locked unit and FIG. 4 shows the kinematic processes involved in locking and unlocking.

Figure 1:
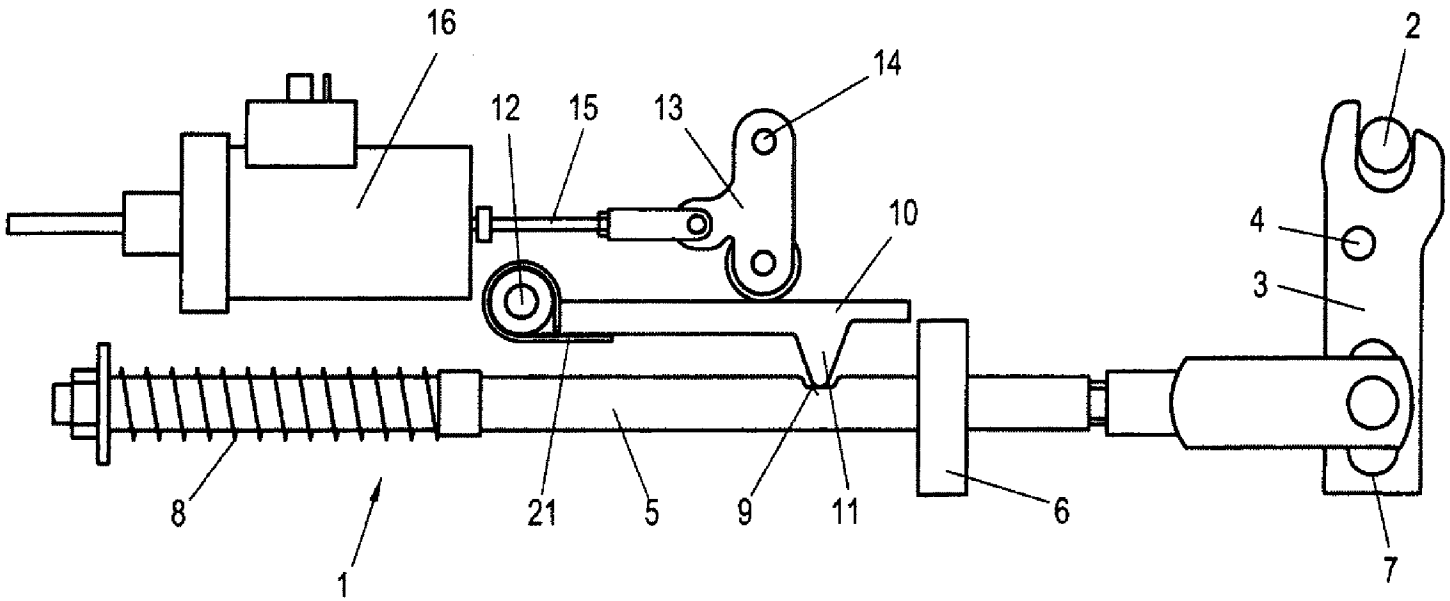

FIG. 1 shows a purely schematic representation of the main components of a locking device 1 according to the invention. The device 1 serves to fix a locking pin 2, which is firmly connected to a door leaf (not shown), in the closed position of the doors, in which it assumes the position represented in FIG. 1. This fixing is accomplished by means of a latch 3, which is capable of pivoting about a center of rotation of the latch axis 4 fixed to the vehicle body. The movement of the locking pin 2 in relation to the latch axis 4 occurs substantially parallel to the axial direction of a guide bar 5, which is fixed to the vehicle body by means of a fastening device 6. A part of the guide bar 5 displaceable along the axis thereof engages in an elongated hole 7 in the latch 3 and is subject to the force exerted by a spring 8, which endeavors to move this moving part out of the position shown in FIG. 1 towards the left, which would bring the latch 4 into its open position.

The guide bar 5 has a notch 9, which interacts with a locking element 11 of a locking lever 10. The locking lever 10 is supported so that it can pivot about a lever axis 12 fixed to the vehicle body and is subjected by a spring 21 to torque about the lever axis, so that its locking element is forced out of the notch, if no further forces or torques are acting thereon.

On its side remote from the locking element 11 the locking lever 10 is subject to the action of a toggle lever mechanism 13, which is supported so that it can rotate about a toggle axis 14 fixed to the vehicle body and which in turn is subject to the action of a drive bar 15 of an actuator 16. The actuator is capable of displacing the drive bar 15 in its axial direction and in so doing is rotatable about an axis 18, running parallel to the axes 4, 12 and 14 and represented in FIG. 2.

FIG. 2 then shows how these components are together supported as a unit by a mounting plate 17, so that no adjustment of any kind is necessary when fitting to the door frame or when positioning correctly opposite the locking pin 2 of the door leaf (not shown). The mounting plate 17 may naturally have a shape other than the plane plate shape and in particular may have bearings guiding each of the various axes above and below the component rotatably supported by the axes, so that it is possible to manage with small, cost-effective bearings. The guide bar 5 is also intended to be mounted on the mounting plate 17, as indicated by the reference numeral 6 for the attachment of the guide bar. Also visible from FIG. 2 is the actuator axis 18 and an emergency actuating device, which is arranged on the side of the actuator 16 remote from the toggle lever mechanism 13 and which allows the doors to be manually opened by the passengers or service personnel, should the drive energy fail.

FIG. 3 shows a purely schematic representation of the interaction of the individual parts between the actuator 16 up to the guide bar 5 under the action of an opening force F acting on the door leaf, and hence on the locking pin 2, the latch 3 and therefore the guide bar 5. As a consequence of the inclined end face of the notch 9 and the corresponding inclined contact face of the locking element 11, and as a function of the friction between these faces, the opening force F running in the axis of the guide bar 5 gives rise to component $F_{normal}$, which acts upon the locking lever 10 substantially in the lever direction, with a slight bending fraction owing to the inclined profile, which leads to a corresponding loading of the bearing of the lever axis 12 and to an extremely low force component perpendicular to the force F introduced to the toggle lever mechanism 13. The virtually friction-free roller 20 of the toggle lever mechanism 13 means that only those forces can be transmitted, which run in the line between the point of contact of the roller 20 with the locking lever 10 and the toggle axis 14. Since this direction runs perpendicular to the direction of the drive bar 15, however, the force FA transmitted to the drive 16 by the locking device 1 according to the invention is equal to zero.

Figures 4A, 4B, 4C:
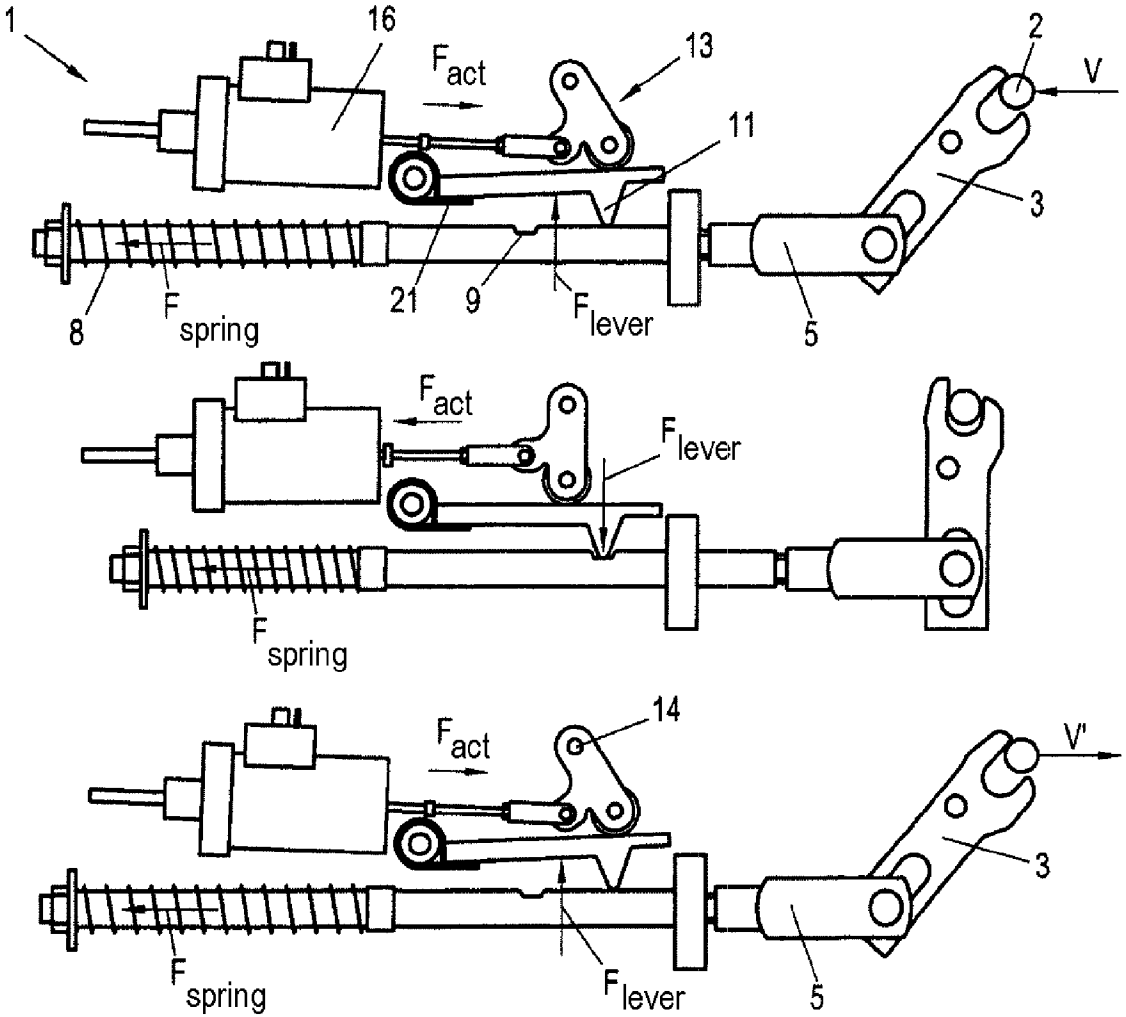

FIG. 4 shows the kinematic sequence of a locking-unlocking process from top to bottom. FIG. 4*a* shows the locking mechanism 1 in its open position: the locking pin 2 moves in the direction of the arrow V into the open area of the latch 3 and, as can be seen from FIG. 4*a* in conjunction with FIG. 4*b*, draws the moveable part of the guide bar 5 into the position shown in FIG. 4*b* against the force of the spring 8 at the end of the movement of the locking pin 2. This movement of the guide bar 5 brings the notch 9 into the area of the locking element 11, and the locking lever 10, against the force of the lever spring 21, is pressed downwards by the toggle lever mechanism 13, which is then activated, until the position shown in FIG. 4*b* is reached with the locking element 11 in the notch 9. In this position the static forces described in FIG. 3 occur and the locking device 1 locks the locking pin 2 without the actuator 16 exerting any force.

To release the locking pin 2 and the door leaf connected thereto, the actuator is first activated so that it swivels the toggle lever mechanism 13 about the toggle axis 14 into the position shown in FIG. 4*c*, thereby bringing the locking lever 10, under the action of its lever spring 21, into the upper position, in which the locking element 11 leaves the notch 9 and therefore releases the guide bar 5, which is now moved under the action of the spring 8 (towards the left of the figure), so that the latch 3 releases the locking pin 2 and the latter can open with the door leaf in the direction of the arrow V'.

The invention is not limited to the exemplary embodiment shown, but can be modified in various ways. Thus instead of the solenoid-based actuator 16 shown another actuator may be provided, the locking element 11 and the notch 9 need not take the form shown but may be designed differently, the bearing and the proportions of the locking lever 10 selected need not be as shown and the guide bar 5 may also be differently configured. The important thing is that in the locked position the toggle lever mechanism 13, in the manner typical of such mechanisms, is situated in a supra-dead-point position, in which the force acting on it via the roller 20 does not apply any torque to it in an opening direction. In the light of the invention the person skilled in the art of kinematics and door locking devices will be easily capable of defining and determining this characteristic, typical of toggle lever mechanisms.

In the case of two-leaf doors, either the two door leaves are kinematically connected to one another, so that it is sufficient to provide one locking pin 2 for both door leaves, or, if single operation of the door leaves is required, one such locking device 1 is to be provided for each of the two door leaves. In this case the two devices may naturally be arranged on a common mounting plate, thereby facilitating installation yet further. As can readily be seen from the description and the drawing, the locking mechanism according to the invention may be combined with all types of door drives, it merely being necessary to co-ordinate its activation with that of the door drive by way of the door electronics.

The invention claimed is:

1. A locking device for sliding doors or hinged sliding doors of vehicles, the locking device comprising:

a latch;

a guide bar connected to the latch and including a notch;

a locking lever including a locking element; and a locking pin configured to be connected to a door leaf, wherein, when the locking pin is in a closed position, the locking pin is fixed in position by the latch, wherein, when the locking pin is in the closed position, the locking element of the locking lever projects into the notch, thus fixing a position of the guide bar, wherein the locking device further comprises a toggle lever mechanism that holds the locking lever in this closed position when the toggle lever mechanism is situated in a supra-dead-point position such that a force acting on the toggle lever mechanism via a roller does not apply any torque to the toggle lever mechanism in an opening direction, and wherein, the closed position is maintained by the locking device in the absence of a door drive exerting any force.

2. The locking device of claim 1, wherein the vehicle doors are included in a rail vehicle.

3. The locking device of claim 1, in combination with sliding doors of a rail vehicle.

4. The locking device of claim 1, in combination with hinged sliding doors of a rail vehicle.

5. The locking device of claim 1, further comprising a drive bar which is configured and positioned to be acted upon by the locking lever to move between a drive bar open position and a drive bar locked position via manipulation of toggle lever mechanism.

6. The locking device of claim 5, further comprising an actuator configured and positioned to displace the drive bar in an axial direction of the drive bar.

7. The locking device of claim 6, wherein the actuator introduces force to the locking element of the locking lever and wherein the toggle lever mechanism completely isolates the force acting between the actuator and the locking element of the locking lever, so that force applied to the actuator adjusts a position of the locking lever.

8. The locking device of claim 7, wherein the actuator is a solenoid-based actuator.

9. The locking device of claim 1, wherein the latch is configured and positioned to pivot about a center of rotation of a latch axis fixed to a body of the vehicle.

10. The locking device of claim 9, wherein the latch axis is substantially parallel to an axial direction of the guide bar, which is also fixed to the vehicle body.

11. The locking device of claim 1, wherein the guide bar is configured and positioned to be displaceable along an axis thereof to engage in an elongated hole in the latch.

12. The locking device of claim 11, further comprising a spring, wherein the guide bar is subject to a force exerted by the spring, which endeavors to move the guide bar to a position that would force the latch into an open position.

13. The locking device of claim 1, wherein the locking lever is supported so that the locking lever pivots about a lever axis fixed to a body of the vehicle and wherein the locking device further comprises a spring that subjects the locking lever to torque about the lever axis so that the locking element is forced out of the notch if no further forces or torques are acting thereon.

14. The locking device of claim 1, further comprising a mounting plate that supports the locking device in such a way that no adjustment of any kind is necessary when fitting the locking device to a door frame.

15. The locking device of claim 1, further comprising a drive bar configured and positioned to be acted upon by the locking lever to move between the drive bar's open position and the drive bar's locked position via manipulation of toggle lever mechanism and an actuator configured and positioned to displace the drive bar in an axial direction of the drive bar, wherein release of the locking pin and a door leaf connected thereto is performed by first activating the actuator so that it swivels the toggle lever mechanism about a toggle axis thereby bringing the locking lever into an upper position, in which the locking element leaves the notch and releases the guide bar so as to release the locking pin.

* * * * *